US005641934A

United States Patent [19]

Follett

[11] Patent Number: 5,641,934

[45] Date of Patent: Jun. 24, 1997

[54] SEE-THROUGH HAND-HELD BULLET-RESISTANT SHIELD

[76] Inventor: Harold Eugene Follett, 100 Reamer Ave., West, Wilmington, Del. 19804

[21] Appl. No.: 423,712

[22] Filed: Apr. 17, 1995

[51] Int. Cl.[6] ..... F41H 5/08

[52] U.S. Cl. ..... 89/36.05

[58] Field of Search ..... 2/2.5; 89/36.05; 109/49.5; 224/257, 914; 29/100

[56] References Cited

U.S. PATENT DOCUMENTS

| | | | |
|---|---|---|---|
| 2,772,450 | 12/1956 | Stewart | 109/49.5 |
| 3,370,302 | 2/1968 | Karlyn | 89/36.05 |
| 3,848,547 | 11/1974 | Schaefer | 86/36.05 |
| 4,674,394 | 6/1987 | Martino | 89/36.05 |
| 4,843,947 | 7/1989 | Bauer et al. | 89/36.05 |
| 5,241,703 | 9/1993 | Roberts et al. | 2/2 |

FOREIGN PATENT DOCUMENTS

| | | | |
|---|---|---|---|
| 2560980 | 9/1985 | France | 89/36.05 |
| 3709035 | 11/1987 | Germany | 89/36.05 |
| 7640 | of 1912 | United Kingdom | 2/2.5 |
| 139121 | 2/1920 | United Kingdom | 2/2.5 |
| 2209820 | 5/1989 | United Kingdom | 89/36.05 |
| 2221286 | 1/1990 | United Kingdom | 89/36.05 |

OTHER PUBLICATIONS

Laible, Roy C., Ballistic Materials and Penetration Mechanics, p. 132. 1980.

*Primary Examiner*—Michael J. Carone
*Attorney, Agent, or Firm*—Robert W. Black

[57] ABSTRACT

See-through, hand-held, bullet-resistant shields are disclosed which provide life-saving upper body protection for a police officer, shopkeeper, bank teller or any person holding said shield, or standing or ducking behind said shield when substantially vertically mounted on the side of a counter top surface. Such shields are formed from a totally see-through or substantially transparent (no lens) bullet-resistant sheet material, capable of being vertically disposed and of a size and shape so as to provide upper body frontal protection of at least a person's face, head, neck, forearm, hand and upper chest anatomy; and has at least one hand-gripping means centrally attached to and spaced from one side of said transparent sheet.

4 Claims, 2 Drawing Sheets

FIG. 1
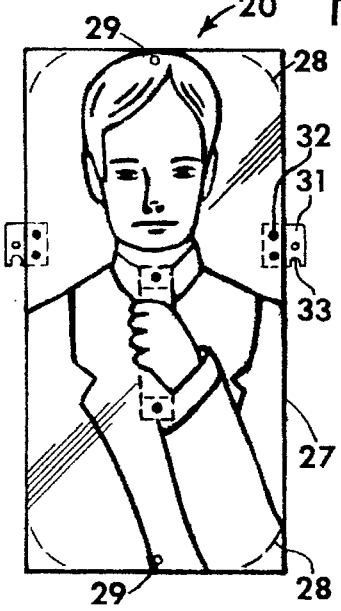
FIG. 2
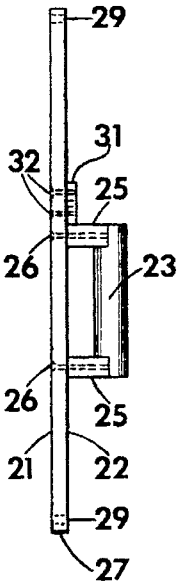
FIG. 3
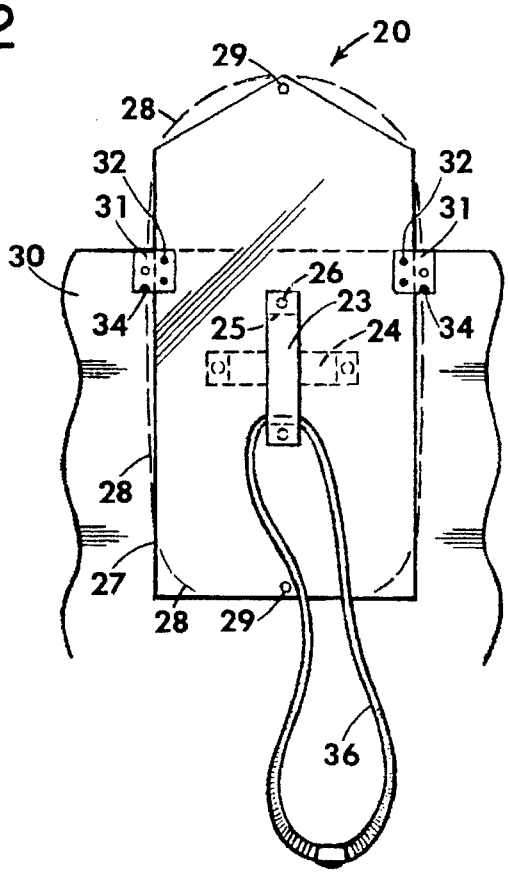
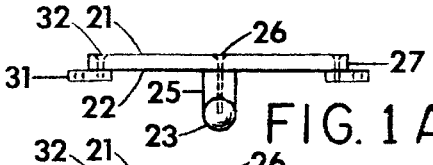
FIG. 1A
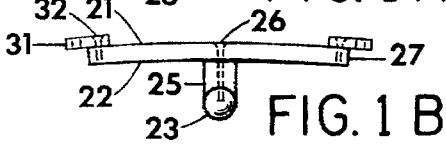
FIG. 1B
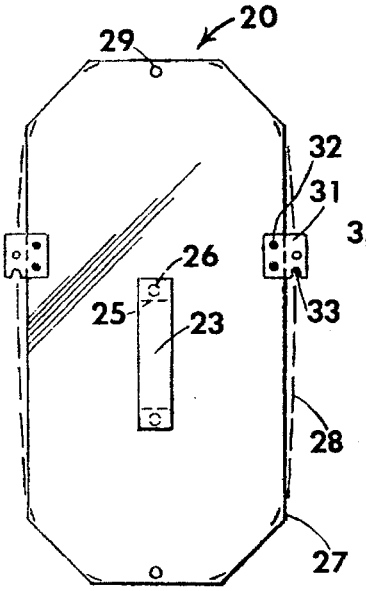
FIG. 4
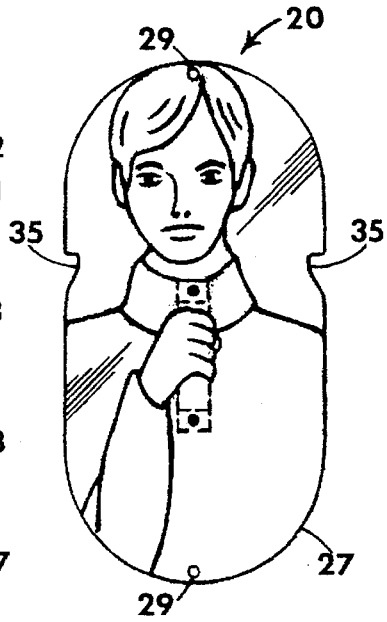
FIG. 5
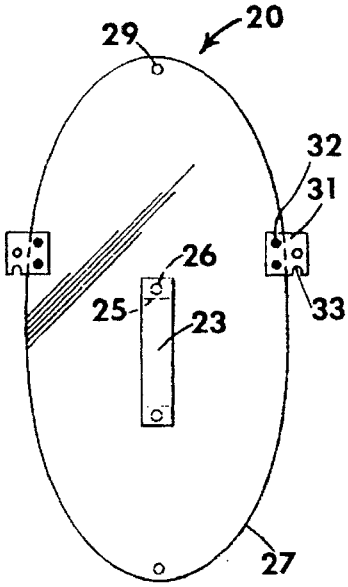
FIG. 6

SEE-THROUGH HAND-HELD BULLET-RESISTANT SHIELD

BACKGROUND OF THE INVENTION

1. Field of the Invention

This invention relates to hand-held shields for upper-body protection, and more particularly to totally see-through or substantially transparent bullet-resistant shields that are optionally mountable vertically on the side of counter top surfaces for standing or ducking behind and removable for quick portable hand-held bullet interception from any direction.

2. Background

The news media reports daily of "drive-by shootings," bank and store holdups, cadackings, burglaries, homicides, and the shooting of police officers who approach suspicious vehicles or enter buildings housing an armed suspect. Police departments, to date, have been using non-ballistic transparent riot shields, expensive non-see-through ballistic shields with limited viewing lens plates, ballistic faceshields and bullet resistant vests made from a wide variety of armor such as ceramics, glass, reinforced plastics, polyaramids, polyethylenes, polycarbonates, aluminum alloys, and steel. Such armored products for law enforcement is commercially available from various companies. U.S. Pat. No. 5,241,703, granted Sep. 7, 1993 to Roberts et al. and U.S. Pat. No. 4,674,394, granted Jun. 23, 1987 to Martino describe two types of protective shields.

However, there remains an acute need in the public service sector, particularly for police officers as well as in the workplace and private community, for a see-through or transparent hand-held, portable shield of manageable weight, that is moderately priced which not only protects people from non-ballastic projectiles such as rocks but now provides as disclosed, bullet resistance with an unlimited see-through (no lens) view of a suspect attacking, running, walking, or hiding while carrying or shooting a gun.

SUMMARY OF THE INVENTION

According to the present invention, there is provided a hand-held protective shield which comprises a generally curved or closed plane elongated sheet formed of a totally see-through or substantially transparent bullet resistant material with projecting perimetrical edges thereon, said sheet capable of being vertically disposed and of a size and shape so as to provide upper body frontal protection of at least a person's face, head, neck, forearm, hand, and upper chest anatomy; and at least one hand-gripping means centrally attached to and spaced from one side of said transparent sheet, said handle of a shape and size to allow the fingers of at least one hand to grasp securely.

Also provided is a bullet-resistant shield wherein the projecting perimetrical edges are configured so as to range from a full rectangular transparent shape, as shown in FIG. 1, to various diminished shapes as shown in FIGS. 3–12, including curved or angled edges and curved or angled edge intersections. These shapes provide, as shown or in combination, upper body bullet-resistant protection.

Further provided is a bullet-resistant shield having at least one optional hole, notch, or hanger plate attachment for mounting the shield vertically on the side of a counter top or on any predetermined surface, such a shield enables a shopkeeper or bank teller to work hands-free on another matter, but the shield is nearby to stand or duck behind or in a ready position to grasp the handle, and, if necessary, quickly dismount and hold the shield in front of one's self, providing portable see-through upper body multi-hit, bullet-resistant protection from any direction.

THE DRAWINGS

FIG. 1 is a shooter's front view of an elongated rectangular totally or substantially transparent bullet resistant protective shield according to the present invention.

FIG. 1A is a top view of the shield of FIG. 1 showing a closed plane (flat) sheet with handle and mounting means.

FIG. 1B is a top view of the shield of FIG. 1 showing a slightly curved (convex and concave) sheet with handle and mounting means.

FIG. 2 is a side view of the shield of FIG. 1.

FIGS. 3, 4, 6, 8–12 are back or rear views of various shields showing elongated projecting perimetrical edge shapes which provide upper body frontal protection similar to the shield of FIG. 1, but having diminished edge shapes to reduce weight.

FIGS. 5 and 7 are shooter's front views of two other shields showing elongated projecting perimetrical edge shapes which provide upper body frontal protection similar to the shield of FIG. 1, but having diminished edge shapes to reduce weight.

DETAILED DESCRIPTION OF THE INVENTION

Figure 7:
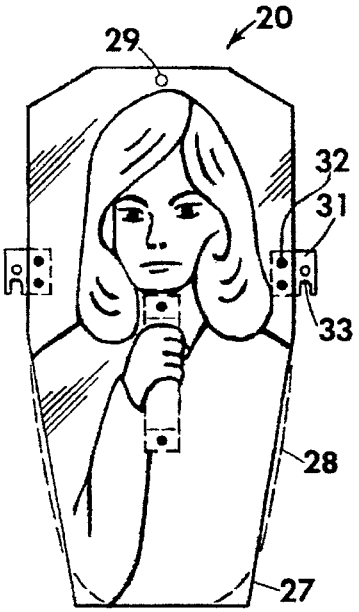

Reference is made to each drawing where like parts are designated by one or the same numeral, where a see-through, hand-held, bullet-resistant protective shield is referred to generally by reference numeral 20.

Protective shield 20 is elongated in the vertical direction so as to conform generally to the vertical direction of a human body. Shield 20 is formed from a totally or substantially transparent, bullet-resistant sheet material, preferably in a range of about ¾ inch to about 2 inches thick. Of several manufactured transparent bullet-resisting sheet materials, one option is a 3-ply polycarbonate laminated sheet manufactured by the General Electric Company called LEXGARD® MP-750. A 0.775 inch thick sheet of this material weights 5.1 pounds per square foot and is, "Recognized by Underwriters Laboratories as providing Level 1 (9 mm) protection per UL Standard 752."

Figure 8:
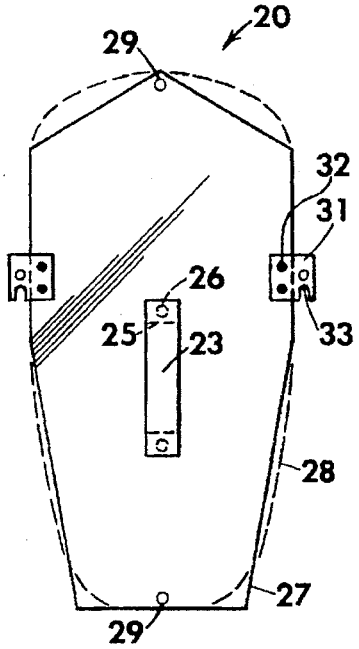
Figure 9:
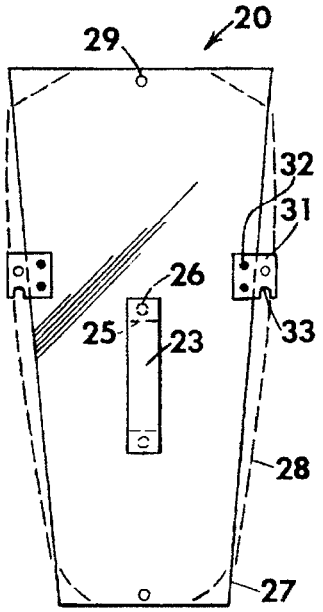
Figure 10:
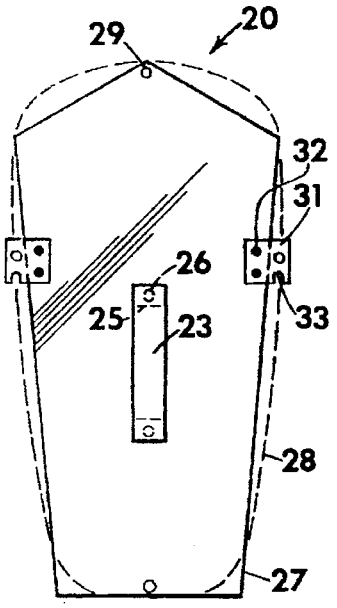
Figure 11:
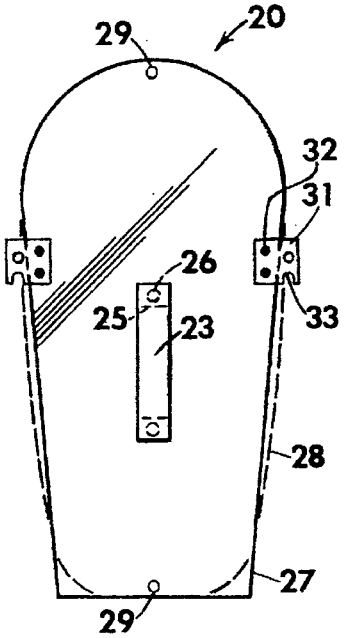
Figure 12:
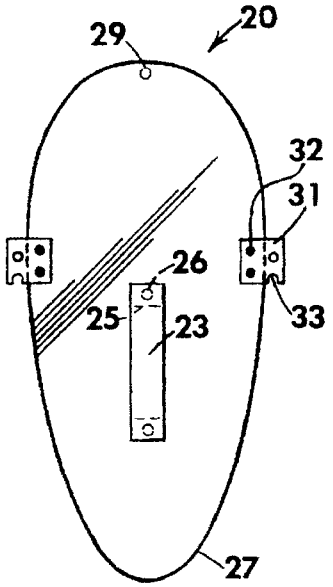

The outer surface 21 and inner surface 22 of shield 20 can be either flat as shown in FIG. 1A top view or curved (convex and concave) as shown in FIG. 1B top view. As shown from a shooter's see-through frontal view in FIGS. 1, 5 and 7, a person holds the shield with at least one hand by means of a hand-gripping means 23 or 24, e.g., a substantially vertical or horizontal extending cylindrical or tubular handle, centrally attached to and spaced from one side of shield 20. As shown in FIG. 2, the handle 23 or 24 can be firmly secured through mounting means 25 and through the sheet body of shield 20 by machine screws 26 or bolts, using washers, transparent plastic plates, nuts or any equivalent attachment means. In order to provide upper body protection of at least a person's face, head, neck, forearm, hand and upper chest anatomy, the sheet material forming the main body of shield 20 provides broad protection at about one foot wide by about 2 feet high rectangularly shaped as shown in FIG. 1 for an average-sized person. The exact width and height of shield 20 may be larger or smaller to protect different sized people. To protect different sized people and to reduce the weight of shield 20, the projecting perimetrical edges 27 of the rectangular sheet material shown in FIG. 1 can be cut to various diminished solid-line or dotted-line edges 27 and 28, respectively, as shown in FIGS. 1–12.

As shown in FIGS. 2 and 3, at least one vertical hand-gripping means 23 is centrally attached to and spaced from one side of shield 20 and is preferably a substantially vertical or optionally a horizontal extended cylinder shaped handle 24 or tube of sufficiently large diameter (about 1 ½ inches) so as to enable a person to hold shield 20 firmly and securely with at least one hand with minimal turning or twisting, especially when the outer surface 21 of the shield is struck by a bullet. The handle 23 or 24 can be made of various light weight metal, elastomer or plastic materials so as to reduce weight and can have cushioning material affixed to its outer surface shaped for comfortable gripping. Also, handle 23 or 24 can be attached to shield 20 through mounting means 25 formed from either metal or plastic material or a shock-absorbing material such as compressible rubber or coiled spring materials.

Shield 20 can also be stored or hung by means of at least one optional hole 29 formed near a perimeter edge. As shown in the drawings, hole(s) 29 can be used for mounting shield 20 on a substantially vertical surface such as a wall or any counter edge by simply inserting the hole over a protrusion from the surface such as a nail or screw.

A preferred optional mounting means shown in FIG. 3 for counter top 30 or any substantially vertical surface, as disclosed, are preferably two detachable hanger plates 31 attached near two opposite perimetrical edges of shield 20, via screws 32 as shown in the drawings. By attaching two hanger plates having notches 33 on opposite perimetrical edges of shield 20, the shield can be mounted or hung on two screws 34, as shown in FIG. 3, or other notch-fitting spaced protrusions affixed to a vertical surface such as a vertical edge of counter top 30. This allows a shopkeeper or bank teller to have the shield near-by to stand or duck behind and also provides protection by having the upper part of the shield extending above the counter top and if necessary, quickly removed for handle-held portable bullet-resistant protection in any direction.

As an alternative to hanger plates 31, all of the shields shown in FIGS. 1–4 and 6–12 may be mounted or hung as shown in FIG. 5. As shown, notches 35 are cut into opposite perimetrical edges 27 for mounting the shield on any substantially vertical surface similar to FIG. 3. As further shown in FIG. 3, an optional resilient carrying strap means 36 can be attached and detached to the handle-gripping means 23 or 24 for hands-free portability. In use, the strap can be used to suspend the shield over the shoulder of the carrier, enabling the carrier to run and to bring the shield into position when required. As apparent from the drawings and above description, the scale or size and thickness of the hand-held shield can be manufactured to suit different sized people with predetermined bullet-resistant requirements.

As will be obvious to one skilled in the art, flashlights and other light-weight equipment can be attached to shield 20 by suitable holders or fasteners such as Velcro straps. Scratch or dent resistant pads can easily be bonded to the shield surfaces. Also, parts of the shield, such as the lower part, can be translucent or opaque. The carrier of shield 20 for any reason desired may also hold shield 20 upside down vertically or in any position necessary to intercept or "catch a bullet" as a matter of self-preservation.

What is claimed is:

1. A hand-held protective shield comprising: a generally curved or closed plane elongated sheet formed of a totally see-through or substantially transparent bullet-resistant material with projecting perimetrical edges thereon, wherein at least one optional hole is formed near a perimeter edge for mounting said shield on a substantially vertical surface, said sheet capable of being quickly substantially vertically disposed and of a size and shape so as to provide upper body frontal protection of at least a person's face, head, neck, forearm, hand and upper chest anatomy; and only one hand-gripping means wherein the hand-gripping means includes compressible material mounting means positioned between said hand-gripping means and said sheet centrally attached to and spaced from one side of said transparent sheet excluding any other non-hand-gripping holding means anywhere on the said shield, said hand-gripping means of a shape and size to allow the fingers of at least one hand to grasp securely.

2. The hand-held shield of claim 1 wherein at least two notches are cut into opposite perimetrical edges for mounting said shield on spaced protrusions on a substantially vertical surface.

3. The hand-held shield of claim 1 wherein a detachable hanger plate is attached to opposite perimetrical edges, said plates notched whereby said shield can be mounted on spaced protrusions on a substantially vertical surface.

4. The hand-held shield of claim 1 wherein a detachable resilient carrying strap is attached to the hand-gripping means for hands-free portability.

* * * * *